United States Patent [19]

Araki et al.

[11] Patent Number: 4,842,205

[45] Date of Patent: Jun. 27, 1989

[54] SHREDDING MACHINE

[75] Inventors: Yasuo Araki, Fujiidera; Tetsuya Itoh, Nara; Shougo Iwai, Yamatokoriyama; Yoshihalu Fujii, Sakurai, all of Japan

[73] Assignee: Sharp Kabushiki Kaisha, Osaka, Japan

[21] Appl. No.: 143,383

[22] Filed: Jan. 13, 1988

[30] Foreign Application Priority Data

Jan. 13, 1987 [JP] Japan ..... 62-7067
Jan. 13, 1987 [JP] Japan ..... 62-7068
Jan. 13, 1987 [JP] Japan ..... 62-7069
Jan. 13, 1987 [JP] Japan ..... 62-7070

[51] Int. Cl.[4] ..... B02C 25/00

[52] U.S. Cl. ..... 241/34; 241/225

[58] Field of Search ..... 83/356.3, 343; 271/34, 271/110, 35, 111, 258, 259, 162, 165, 256, 164; 241/100, 101.2, 34, 36, 224, 222, 225, 236

[56] References Cited

U.S. PATENT DOCUMENTS 2,732,138 1/1956 Forth ..... 241/34 X
4,192,467 3/1980 Hatanaka ..... 241/34

FOREIGN PATENT DOCUMENTS 2214799 9/1973 Fed. Rep. of Germany .
328052 2/1958 Switzerland ..... 241/34

*Primary Examiner*—Mark Rosenbaum
*Attorney, Agent, or Firm*—Birch, Stewart, Kolasch & Birch

[57] ABSTRACT

A shredding machine which comprises a pair of juxtaposed cutting rollers for shredding paper material, a paper feed tray movable between lowered and elevated positions and adapted to support thereon the paper material to be shredded, a feed roller assembly for feeding the paper material from the paper feed tray towards the cutting rollers, a protective cover supported for movement between closed and opened positions and for covering a space above the paper feed tray when in the closed position; and a control for moving the paper feed tray from the elevated position towards the lowered position in response to the movement of the protective cover from the closed position towards the opened position.

4 Claims, 10 Drawing Sheets

SHREDDING MACHINE

BACKGROUND OF THE INVENTION

1. Field of the Invention

The present invention generally relates to a cutting machine for cutting papers into pieces such as documents to be discarded or disposed and, more particularly, to a shredding machine or shredder.

2. Description of the Prior Art

A shredder provided with a paper feed mechanism for feeding papers to be cut into pieces is well known and disclosed in, for example, the German Pat. No. 2,214,799 first published Sept. 27, 1973.

According to the German patent, the paper feed mechanism provided in the shredder comprises a paper tray supported by a machine side wall for movement up and down between lowered and elevated positions, a spring means for urging the paper tray to the elevated position at all times, and a motor-driven paper feed roller positioned immediately above the paper tray in the elevated position. This paper feed mechanism is so designed that, assuming that a batch of papers to be shredded is placed on the paper tray and urged up against the paper feed roller through the paper tray by the action of the spring means with the uppermost paper held in contact with the paper feed roller, one or a number of the papers can be fed towards a rotary cutter assembly comprised of a pair of juxtaposed cutting rollers for shredding.

Since, according to the German patent, the paper tray is normally urged towards the paper feed roller, the placement of a batch of papers to be shredded on the paper tray requires an operator of the shredder to push the paper tray down towards the lowered position, causing the machine to require a complicated handing procedure.

Also, when the cutting rollers being driven in one direction during the shredding operation are reversed so as to rotate in the opposite direction for the purpose of interrupting the shredding operation and recovering the papers ready to reach the cutting rollers, the papers are fed backwards in a direction away from the rotary cutter assembly. However, according to the German patent, the path along which the papers are fed from the paper feed roller towards the cutter assembly is very limited and, therefore, no substantial space for accommodating the papers being reversed is available. This may bring about a problem of a paper jam, i.e., the possibility of the reverse-fed papers jamming somewhere in the path of travel thereof between the paper feed roller and the cutter assembly. In addition, when the paper jam is removed or when any trouble occurring somewhere in the machine is removed, the machine immediately assumes a shredding operation, and this may pose a hazardous condition to the operator.

Furthermore, in the machine according to the German patent, in the event that the paper or papers placed on the paper tray are not properly fed from the paper tray towards the cutter assembly by reason of a malfunctioning of the paper feed roller, the machine is usable to detect the occurrence of such malfunctioning. Therefore, the prior art machine according to the German patent has inherent limitations as to the workability and the handling convenience.

SUMMARY OF THE INVENTION

Accordingly, the present invention has been developed with a view to substantially eliminating the above discussed problems inherent in the prior art shredder and has for its essential object to provide an improved shredder of a type wherein the paper tray can be moved between lowered and elevated positions in association with the opening and closure of a protective cover overlaying the paper tray to facilitate the placement of a batch of papers to be shredded on the paper tray.

Another important object of the present invention is to provide an improved shredder of the type referred to above, wherein, when the juxtaposed cutting rollers are reversed in direction of rotation to permit the paper or papers to be fed backwards, the paper tray can be lowered to provide a space for accommodating the reverse-fed papers between the top of the batch of the papers on the paper tray and the paper feed roller assembly, thereby to substantially eliminating the possibility of paper jam.

A further object of the present invention is to provide an improved shredder of the type referred to above, wherein a detecting system is provided for detecting the occurrence of any trouble in the machine so that upon the detection of occurrence of the trouble, not only can the paper tray be lowered to facilitate the removal of the trouble, but also the supply of the papers towards the cutter assembly is interrupted, the detecting system being so designed that the machine will not immediately resume the shredding operation even when the trouble has been removed.

A still further object of the present invention is to provide an improved shredder of the type referred to above, wherein a plurality of paper feed apertures are provided so that, in the event of occurrence of a trouble in a paper feed system associated with one of the paper apertures, the remaining paper feed mouth can be used for the supply of papers towards the cutter assembly, thereby to facilitate the efficient utilization of the machine.

In order to accomplish these objects of the present invention, there is disclosed an improved shredder which comprises a cutting means, a paper feed tray movable between lowered and elevated positions and adapted to support thereon a paper material to be shredded, a feed means for feeding the paper material from the paper feed tray towards the cutting means, a protective cover supported for movement between closed and opened positions and for covering a space above the paper feed tray when in the closed position, and a control means for moving the paper feed tray from the elevated position towards the lowered position in response to the movement of the protective cover from the closed position towards the opened position.

Preferably, the shredder according to the present invention includes a detecting means for detecting the occurrence of any trouble somewhere in the machine so that, upon the detection of the trouble, the paper feed tray can be moved from the elevated position towards the lowered position regardless of the position of the protective cover or regardless of whether or not the protective cover is employed.

According to another preferred embodiment of the present invention, there is provided an improved shredder which comprises a cutting means, a paper feed mechanism including a paper feed tray adapted to support thereon a paper material to be shredded and a paper feed means for feeding the paper material from the paper feed tray towards the cutting means, a first detector for detecting the presence of the paper material on the paper feed tray, a second detector disposed in a path of travel of the paper material from the paper feed mechanism to the cutter means, means for determining, during a period in which the first detector detects the presence of the paper material on the paper feed tray, whether or not the time passed from the timing at which the second detector detects the passage of the trailing end of one paper material therethrough with respect to the direction of feed towards the cutting means to the timing at which the second detector detects the passage of the leading end of the next succeeding paper material therethrough with respect to the direction towards the cutting means has exceeded a predetermined time, and a control means operable in response to a signal from the determining means to interrupt the operation of the paper feed mechanism.

BRIEF DESCRIPTION OF THE DRAWINGS

These and other objects and features of the present invention will become clear from the following description taken in conjunction with a preferred embodiment thereof with reference to the accompanying drawings, in which.

DETAILED DESCRIPTION OF THE EMBODIMENTS

Figure 1:
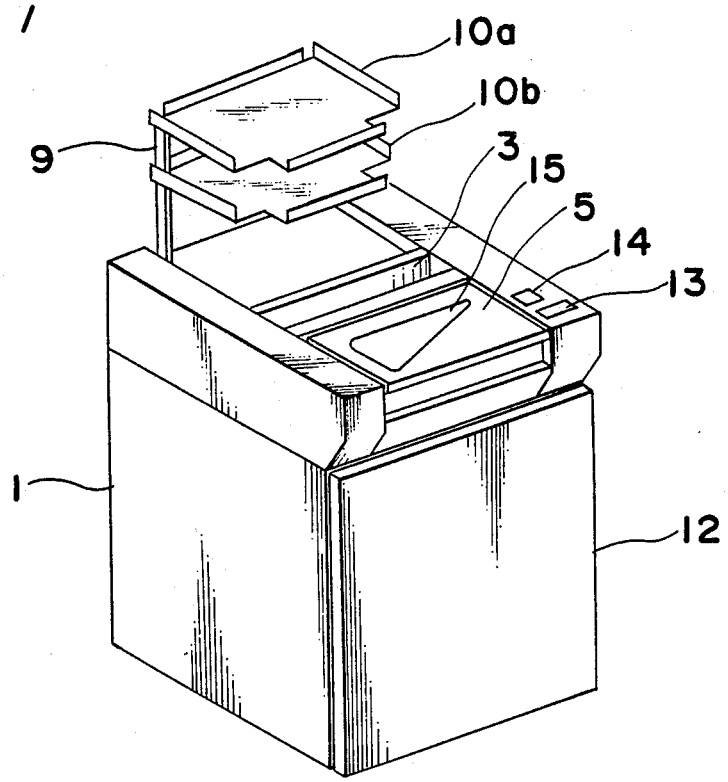
FIG. 1 is a schematic perspective view of a shredder according to a preferred embodiment of the present invention.

Before the description of the present invention proceeds, it is to be noted that like parts are designated by like reference numerals throughout the several views of the accompanying drawings.

Figure 2:
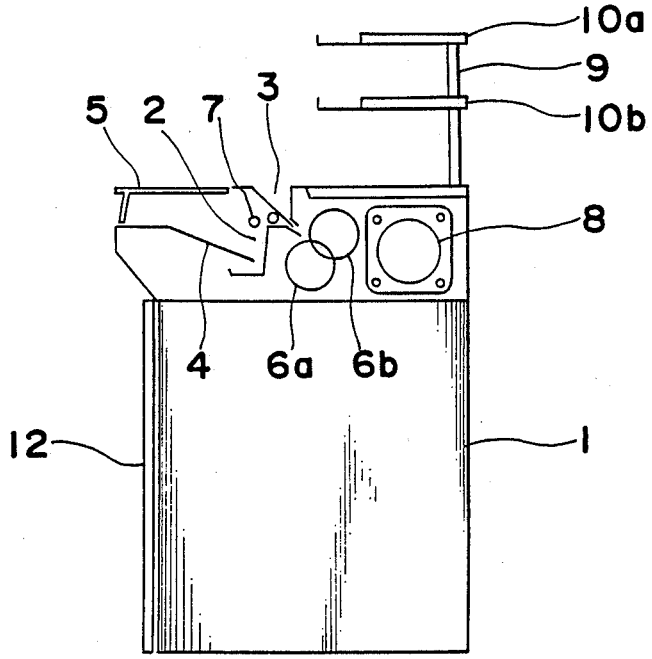
FIG. 2 is a schematic side sectional view of the shredder.

Referring first to FIGS. 1 and 2, a shredder generally identified by 1 comprises a generally rectangular box-like housing having a plurality of, for example, first and second, feed mouths aperture 2 and 3 defined at the top thereof. The first feed mouth 2 comprises a paper feed tray 4 for the support thereon of a batch of papers to be shredded and a protective cover 5 for selectively closing and opening a paper chamber immediately above the paper feed tray 4. The protective cover 5 has a transparent windowpane 15 through which the batch of papers placed on the paper feed tray 4 can be viewed even when the protective cover 5 is in a closed position closing the space immediately above the paper feed tray 4. In this first feed mouth 2, there is disposed a paper feed roller assembly, which may be a rubber-lined roll or a plurality of rollers 7 mounted rigidly on a common carrier shaft 25 (FIG. 3) for rotation together therewith, for feeding one or a number of papers on the paper feed tray 4 towards a pair of juxtaposed cutting rollers 6*a* and 6*b* of any known construction. One or both of the cutting rollers 6*a* and 6*b* forming a cutting means are drivingly coupled with an electric drive motor 8 in any known manner.

The second feed aperture 3 is used to receive one to three papers to be shredded which are manually inserted. The paper or papers entering the second feed aperture 3 can be drawn by and fed through the cutting rollers 6*a* and 6*b*.

In the description that follows, a paper feed system extending between the first feed aperture 2 to the cutting means and including the feed roller assembly is hereinafter referred to as a batch feed system, and a paper feed system extending between the second feed aperture 3 to the cutting means is hereinafter referred to a single feed system.

In the machine, such as in the illustrated instance, wherein the batch and single feed systems are employed, the single feed system may be utilized to receive the papers which are required to be shredded simultaneously while the papers fed through the batch feed system are being shredded. In such case, the supply of the papers through the batch feed system need not be interrupted, and the papers fed through the single feed system can join with the papers fed through the batch feed system as they pass through a cutting zone defined by the cutting rollers 6*a* and 6*b*.

The machine housing includes paper stands 10*a* and 10*b* positioned one above the other and mounted on the machine housing by means of a pair of support pillars 9. Each of these paper stands 10*a* and 10*b* is used to support a respective folded stack of perforated, continuous-form paper which, when each sheet of the perforated, continuous-form paper is desired to be shredded, depends from the associated paper stands 10*a* or 10*b* downwardly into the cutting zone through the second feed mouth 3.

The machine housing also includes hingedly supported front door 12 for selectively opening and closing an access opening leading to a container (not shown) positioned inside the machine housing and immediately below the cutting means for receiving shredded pieces of paper. The container may be a basket having a removable nylon bag installed therein or a disposable box.

A control panel 13 having a display 14 for providing a visual indication of an operating condition of the machine is disposed at any convenient location readily accessible to the eyes of the operator, for example, at the top of the machine housing and laterally offset from the first and second feed mouths 2 and 3.

Figure 3:
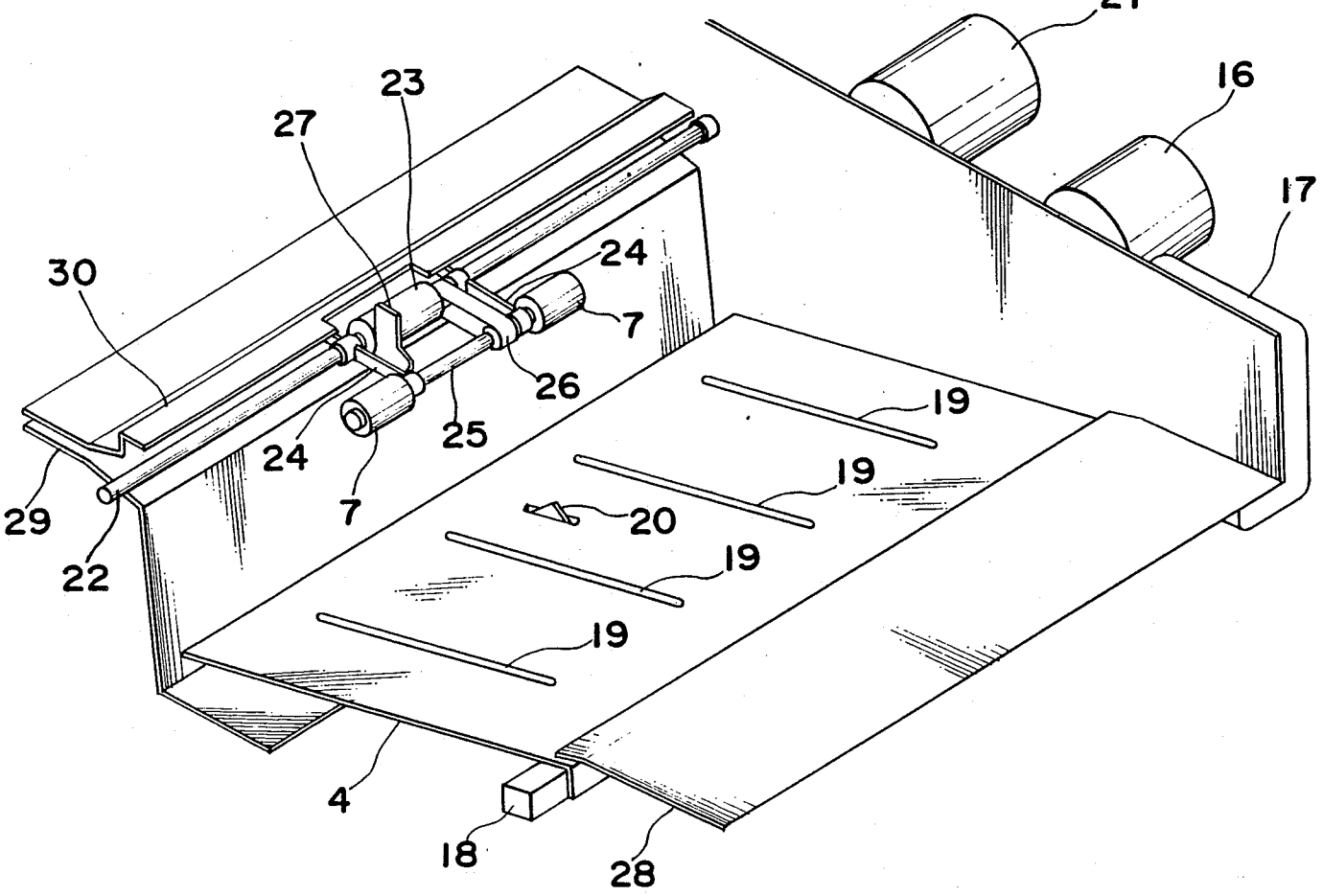
FIG. 3 is a fragmentary perspective view, on an enlarged scale, of a paper feed mechanism used in the shredder.

The details of the batch feed system extending between the first feed aperture 2 to the cutting zone and including the feed roller assembly are best illustrated in FIG. 3.

Referring now to FIG. 3, reference numeral 16 represents a direct current drive motor carried by the machine housing, the drive of which is transmitted through a reduction gear unit 17 to a pivot shaft 18 to which a rear end of the paper feed tray 4, as viewed in the direction of supply of the papers to be shredded, is firmly secured. Thus, it will readily be seen that, during the operation of the drive motor 16, the paper feed tray 4 can be moved between lowered and elevated positions, pivoting about and together with the pivot shaft 18. The paper feed tray 4 has a plurality of elongated indentations 19, for example, ribs or recesses, for the purpose of reinforcing the paper feed tray 4 thereby to minimize any possible deformation thereof, and also an actuator 20 exposed therethrough from below for detecting the presence or absence of the batch of papers or at least one paper on the paper feed tray 4.

Positioned next to the drive motor 16 is a synchronous motor 21 drivingly coupled through a reduction gear unit (not shown) to a shaft 22. The shaft 22 has a conveyor roller 23 rigidly mounted thereon for rotation together therewith and also has a pair of arms 24 mounted thereon for pivotal movement about the shaft 22 independently of the rotation of the shaft 22. The paper feed roller assembly referred to above as constituted by the paper feed rollers 7 is supported by the pair of arms 24 with the common carrier shaft 25 mounted rotatably on free ends of the arms 24 remote from the carrier shaft 25.

The shaft 22 and the carrier shaft 25 are drivingly coupled with each other by means of an endless belt 26 trained therebetween so that, during the operation of the synchronous motor 21 to drive the shaft 22 in one direction, the carrier shaft 25 and, hence, the paper feed rollers 7 can be driven in a direction conforming to the direction of rotation of the shaft 22.

The paper feed mechanism illustrated in FIG. 3 includes an actuator 27 for detecting the position of the uppermost paper of the batch placed on the paper feed tray 4, and some paper guide means such as a guide slide 28 continued to the rear end of the paper feed tray 4 and lower and upper guide plates 29 and 30 which are positioned one above the other so as to define a guide slot therebetween for the passage therethrough of a number of papers to be shredded from the paper feed tray 4.

Further details of the paper feed mechanism including the details of the paper feed systems and the details of the cutting means will be described with particular reference to FIGS. 4 to 6.

A cutter support structure 31 supports the cutting rollers 6*a* and 6*b*, and duct defining wall members 32 and 33 spaced apart from each other so as to define a duct through which shredded pieces of papers can fall downwardly onto the container. The cutter support structure 31 is mounted through a plurality of cushioning pads 34 on a lower housing unit 35 of the machine housing. This lower housing unit 35 of a generally box-like configuration including the hingedly supported front door 12 for selectively opening and closing an access opening leading to the container (not shown) positioned inside such lower unit 35, said lower housing unit 35 having a top wall in which an opening 37 is defined in communication with the duct defined by the wall members 32 and 33. As previously described, the container may be a basket having a removable nylon bag installed therein or a disposable box.

The shafts 18 and 22, the guide slide 28, the protective cover 5 and the guide plates 29 and 30, all forming components of the batch feed system, are supported by a feeder support structure 36. This feeder support structure 36 is mounted directly on the lower housing unit 35 of the machine housing and positioned next to the cutter support structure 31 with respect to the direction perpendicular to the axis of rotation of each of the cutting rollers 6*a* and 6*b*.

Figure 4:
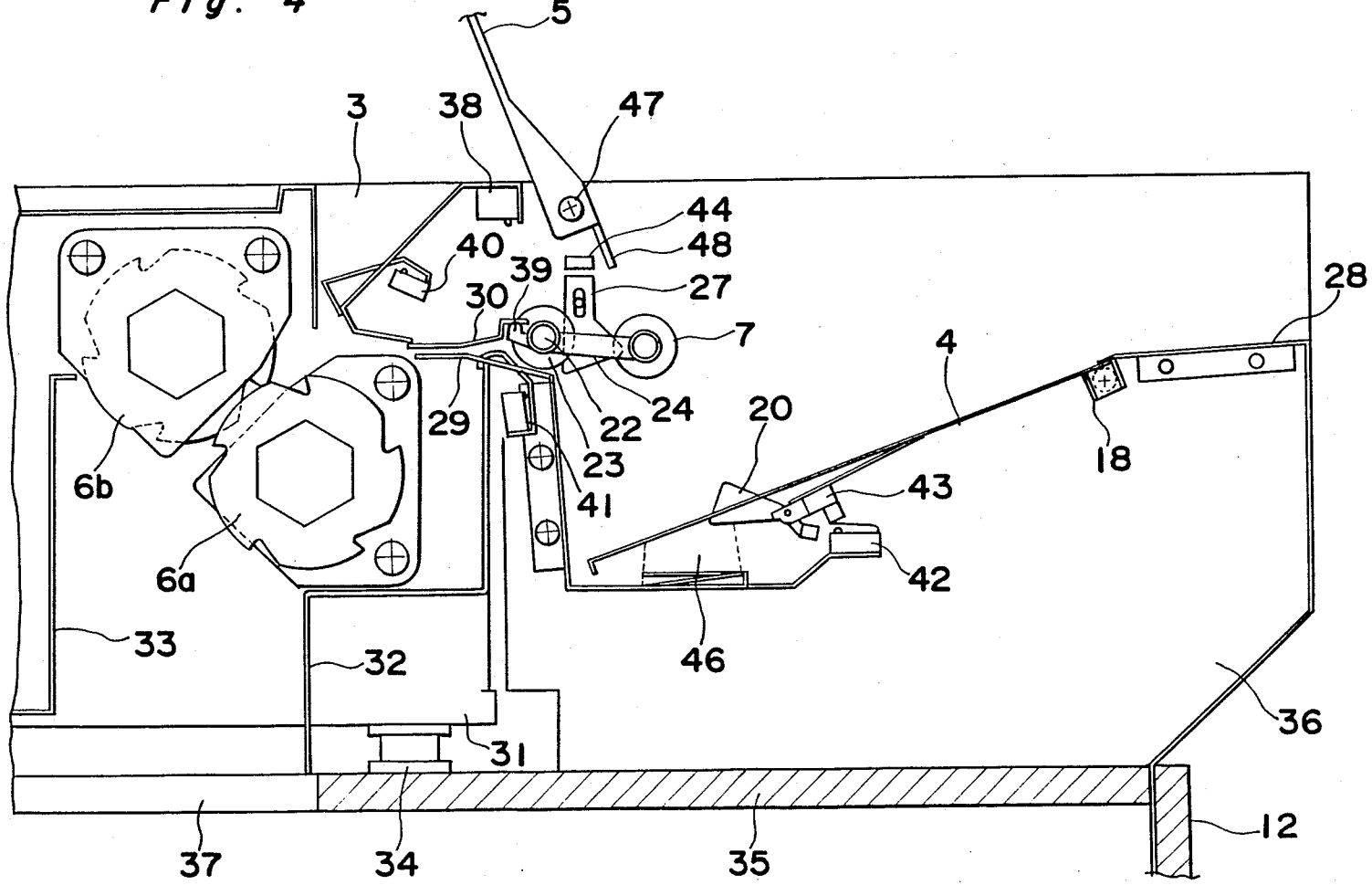
FIGS. 4 to 6 are fragmentary side sectional view of the paper feed mechanism shown in FIG. 4, illustrating the paper feed trays at different operative positions.

FIG. 4 illustrates the machine with the protective cover 5 held in the opened position. As the protective cover 5 is moved from the closed position towards the opened position, a cover sensor switch (CSW) 38 is switched off to cause the paper feed tray 4 to move from the elevated position towards the lowered position about the pivot shaft 18. During the movement of the paper feed tray 4 towards the lowered position, the paper feed rollers 7, touching the uppermost sheet of the stack of the papers feed tray 4 depending on the presence or absence of the stack of papers on the paper feed tray 4, pivots clockwise, as viewed in FIG. 4, about the shaft 22 and, when the paper feed rollers 7 are disengaged from the uppermost sheet of the stack of the papers, a projection connected to, or otherwise integrally formed with one of the arms 24 so as to project in a direction remote from the paper feed rollers 7 is brought into engagement with a front edge of the upper guide plate 30 confronting the conveyor roller 23 on the shaft 22 and no further clockwise pivotal movement of the paper feed rollers 7 about the shaft 22 take place as shown.

The machine includes electric sensor switches 40, 41, 42, 43 and 44. The sensor switch 40 is positioned and operable so as to detect the insertion of the paper to be shredded into the paper feed aperture 3. The sensor switch 41 is so positioned and so operable as to detect the presence or absence of the papers in a duct defined between the lower and upper guide plates 29 and 30. The sensor switch 42 is positioned and operable so as to detect the arrival of the paper feed tray 4 at the lowered position as shown in FIG. 4. The sensor switch 43 is positioned and operable so as to detect the presence or absence of the stack of papers on the paper feed tray 4 and is operatively coupled with the actuator 20 partially exposed upwardly through the paper feed tray 4 from below. The sensor switch 44 operatively coupled with an actuator 27 is positioned and operable so as to detect the position of the uppermost sheet of the stack of papers 45.

Figure 5:
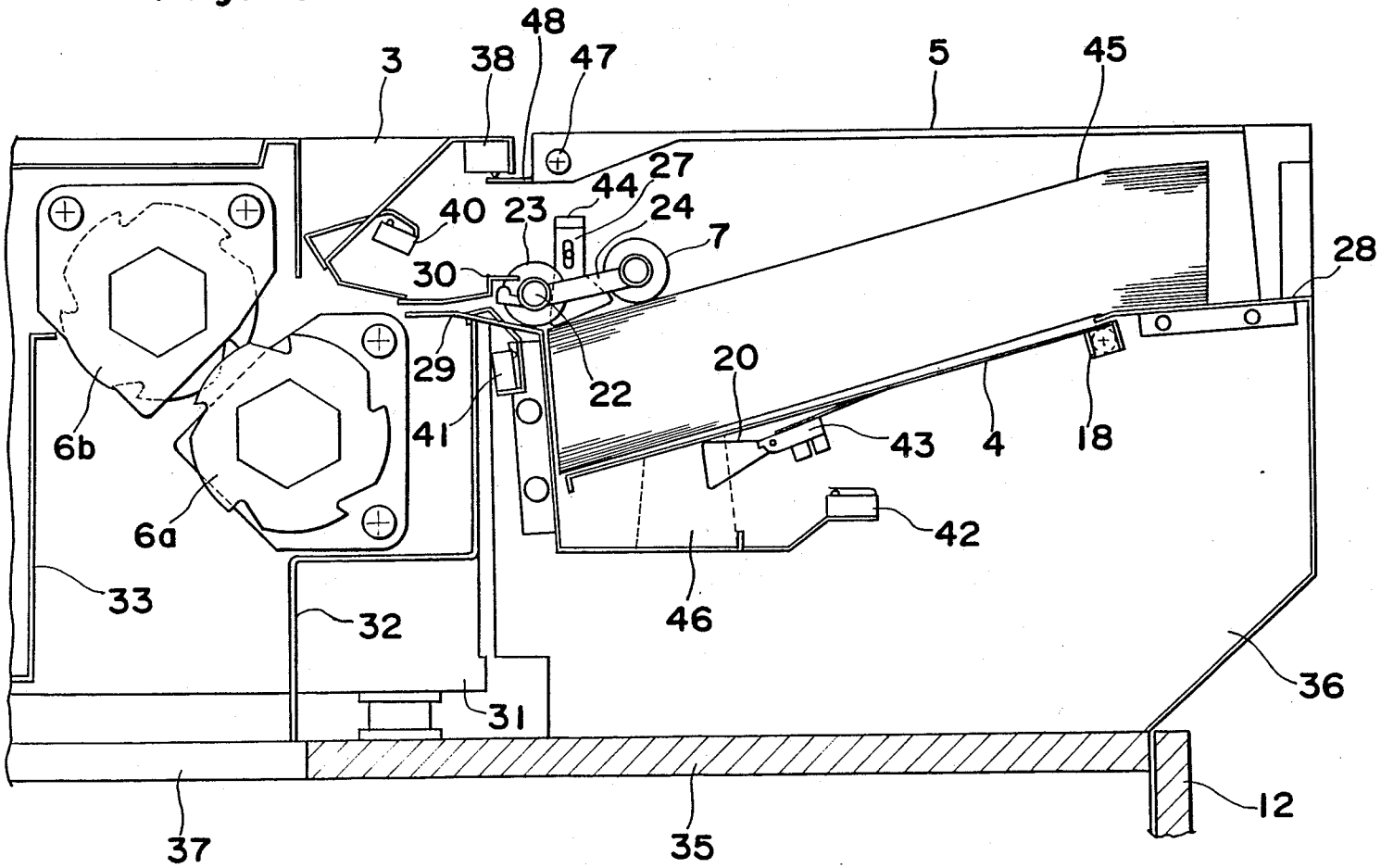

FIG. 5 illustrates the machine with the stack of about 300 to 500 sheets of paper 45 placed on the paper feed tray 4 and also with the paper feed tray 4 elevated. In this condition, the paper feed tray 4 is elevated, i.e., pivoted clockwise, as viewed in FIG. 5, about the pivot shaft 18 enough to permit the uppermost sheet of the stack of papers 45 to activate the actuator 27 with the sensor switch 44 consequently switched on. It is to be noted that a compression spring 46 is disposed between a carrier plate and the paper feed tray 4 for urging the paper feed tray 4 in a direction towards the elevated position, and this compression spring 46 is utilized only for the purpose of lessening a load which would be imposed on the direct current drive motor 16.

Figure 6:
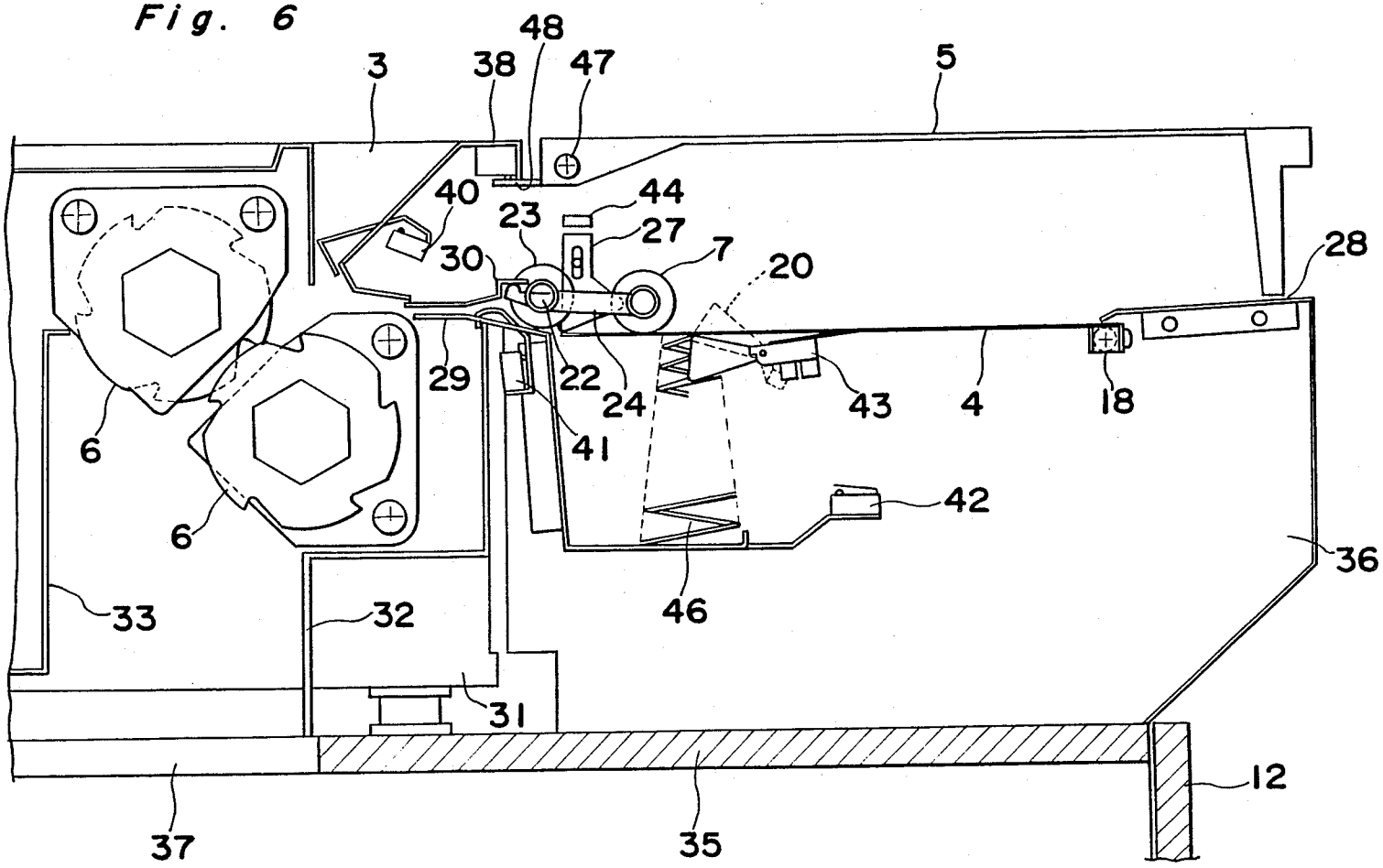

FIG. 6 illustrates the condition of the machine wherein only about a few sheets of paper are remaining on the paper feed tray 4. As can be readily understood from the comparison of the position of the paper feed rollers 7 shown in FIG. 5 and that shown in FIG. 6, the greater the number of papers of the stack placed on the paper feed tray 4, the higher the position of the paper feed rollers 7. In other words, the paper feed roller assembly comprised of the rollers 7 is so positioned and so supported as to pivot about the shaft 22 between a downwardly shifted position, as shown in FIG. 4, and an upwardly shifted position as shown in FIG. 5, the upwardly shifted position of the paper feed roller assembly being located a distance upwardly of the paper feed tray 4 which has been brought to the elevated position as shown in FIG. 6.

It has now become clear that the protective cover 5 is supported for pivotal movement between the closed position, as shown in FIGS. 5 and 6, and the opened position as shown in FIG. 4. A portion of the protective cover 5 on one side of stud shafts 47, about which the protective cover 5 pivots, opposite to the space immediately above the paper feed tray 4 is integrally formed with a projection 48 for depressing the cover sensor switch (CSW) 38 so as to switch the latter on only when the protective cover 5 is pivoted to the closed position.

Figure 7:
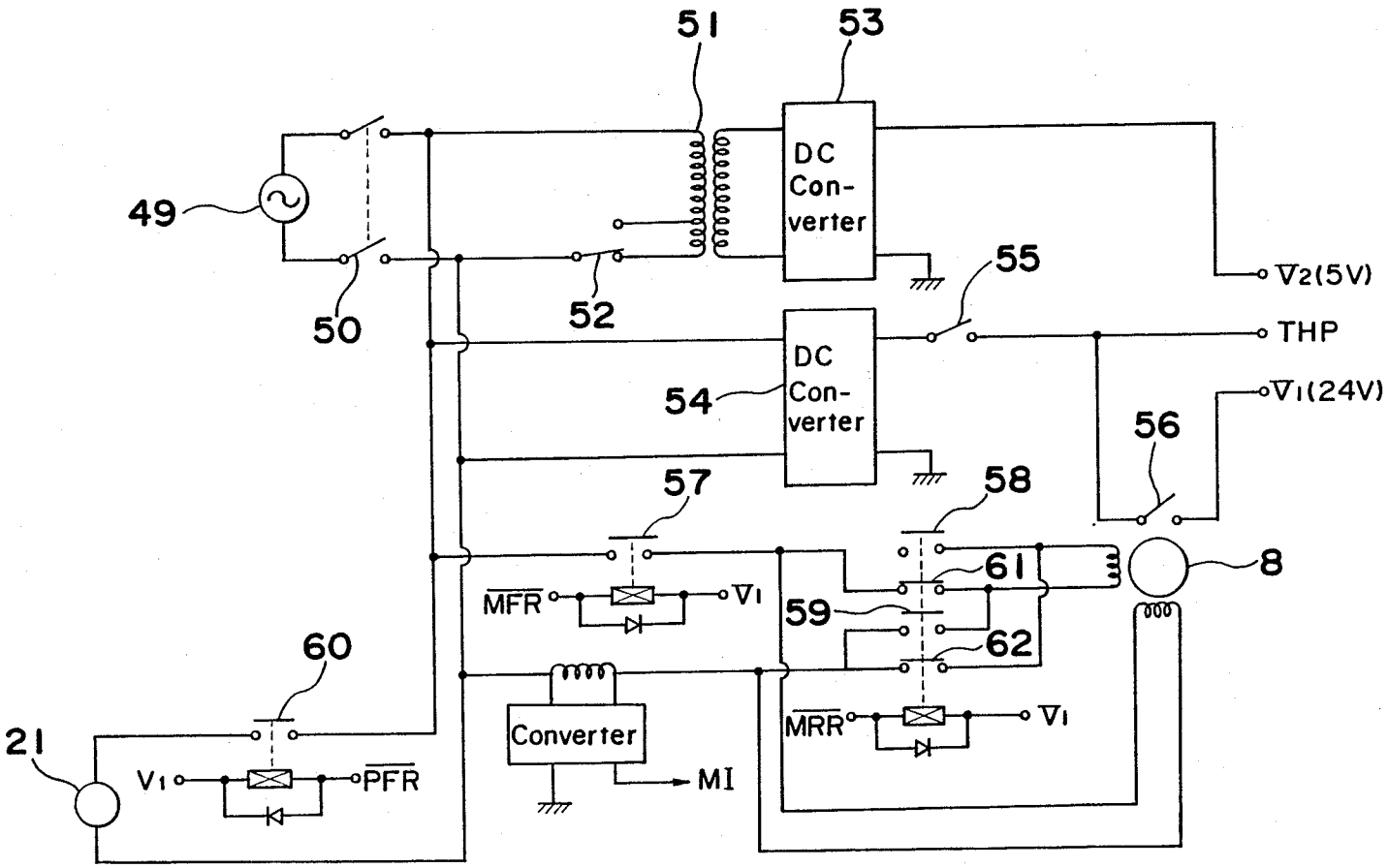
FIGS. 7 to 14 are circuit block diagrams showing electric control circuits used in the shredder.

FIG. 7 illustrates an electric control circuit used to control the operation of the cutter drive motor 8 for driving the cutting rollers 6*a* and 6*b* and also the synchronous motor 21 for driving the paper feed roller assembly. In this figure, reference numeral 49 represents an AC power source which may be a commercial electric power outlet. A transformer 51 has a primary winding connected with the alternating current power source 49 through a voltage selector switch 52 and a main power switch 50. The the selector switch 52 is utilized to make the machine according to the present invention suit for use in a particular region of the world depending on the rated voltage available from the commercial power outlet. A secondary winding of the transformer 51 is connected with a AC-DC converter 53 for converting the alternating current into a direct current.

The power source 49 is also connected through the main power switch 50 with another AC-DC converter 54 for converting the alternating current into a direct current, an output of said converter 54 being connected with a sensor switch 55 for detecting the opening of the access door 12. The sensor switch 55 is in turn connected in series with a safety sensor switch 56 used to detect an abnormal increase of the temperature of the cutter drive motor 8.

Reference characters $\overline{MFR}$, $\overline{MRR}$ and $\overline{PFR}$ represent respective inverted versions of a drive signal MFR for driving the cutter drive motor in a forward feed direction, a reverse-drive signal MRR for driving the cutter drive motor in the opposite, reverse feed direction and a paper feed signal PFR. Accordingly, when the inverted signal $\overline{MRR}$ is in low level state, the cutter drive motor 8 can be driven in the reverse feed direction. When the inverted signal $\overline{MFR}$ is in low level state and the inverted signal $\overline{MRR}$ is in high level state, the cutter drive motor 8 is driven in the forward feed direction, but when the inverted signal $\overline{MFR}$ is in low level state and the inverted signal $\overline{PFR}$ is in low level state, the synchronous motor 21 can be driven.

It is to be noted that switches 57, 58, 59 and 60 used in the control circuit of FIG. 7 are normally opened switches while switches 61 and 62 are normally closed switches, the operation of each of which will become clear from the subsequent description.

Tray Position Control

The paper feed tray 4 is controlled to pivot from the elevated position towards the lowered position about the pivot shaft 18 when the protective cover 5 in the closed position is opened, when the stack of papers on the paper feed tray has been completely fed out from the paper feed tray 4 or when no paper is placed on the paper feed tray 4, when the cutter drive motor is driven in the reverse feed direction and when erroneous supply of the papers to be shredded has occurred. Also, when the stack of papers to be shredded is placed on the paper feed tray 4, the latter is pivoted about the pivot shaft 18 until the uppermost sheet of the stack of papers on the paper feed tray 4 actuates the actuator 27 to switch the sensor switch 44 on.

Control of Cutter Drive Motor

When either the switch 40 or the switch 44 is turned on and for a predetermined time subsequent to the switching off of one of the switches 40 and 44, the cutting rollers 6*a* and 6*b* are driven in one direction to effect the actual shredding operation. However, in the event that the cutting rollers 6*a* and 6*b* are overloaded during the actual shredding operation, the cutting rollers 6*a* and 6*b* are brought to a halt. Once the cutting rollers 6*a* and 6*b* are stopped as a result of the overloading, no further insertion of the papers into the paper feed mouth 3 will not cause the cutting rollers 6*a* and 6*b* to resume the shredding operation. In order for the cutting rollers 6*a* and 6*b* to resume the shredding operation, a reverse switch has to be depressed to cause the cutting rollers 6*a* and 6*b* to be reverse-driven in the opposite direction before the cutting rollers 6*a* and 6*b* are to be driven in the one direction.

Control of Paper Feed

Assuming that the stack of papers to be shredded is placed on the paper feed tray 4, the paper feed rollers 7 and the conveyor roller 23 are driven to draw a number of papers from the paper feed tray 4 towards the cutting rollers 6*a* and 6*b* . This paper feed operation will be (i) No paper pass through the duct defined between the lower and upper guide plates 29 and 30 even after a predetermined time has passed subsequent to the start of the paper feed.

(ii) Within a predetermined length of time subsequent to the passage of the paper through the duct defined between the guide plates 29 and 30, no next succeeding paper is drawn from the paper feed tray 4 so as to pass through the duct between the guide plates 29 and 30.

(iii) The paper feed tray 4 has been emptied.

Simultaneous Supply from Mouths 2 and 3

Papers drawn from the stack of papers on the paper feed tray 4 into the paper feed mouth 2 and papers inserted through the paper feed mouth 3 can be simultaneously shredded by the cutting rollers 6*a* and 6*b*.

Also, since the cutting rollers 6*a* and 6*b* are so designed as to be driven if the switch 40 is turned on even when the batch feed system fails to operate properly as a result of incorrect feed of the papers, the shredding operation with respect to the papers inserted through the paper feed mouth 3 can be effected.

Referring now to FIGS. 8 to 14, control circuits necessitated to carry out the various controls described above will be described, timing charts of which are shown in FIGS. 15 to 18.

Figure 8:
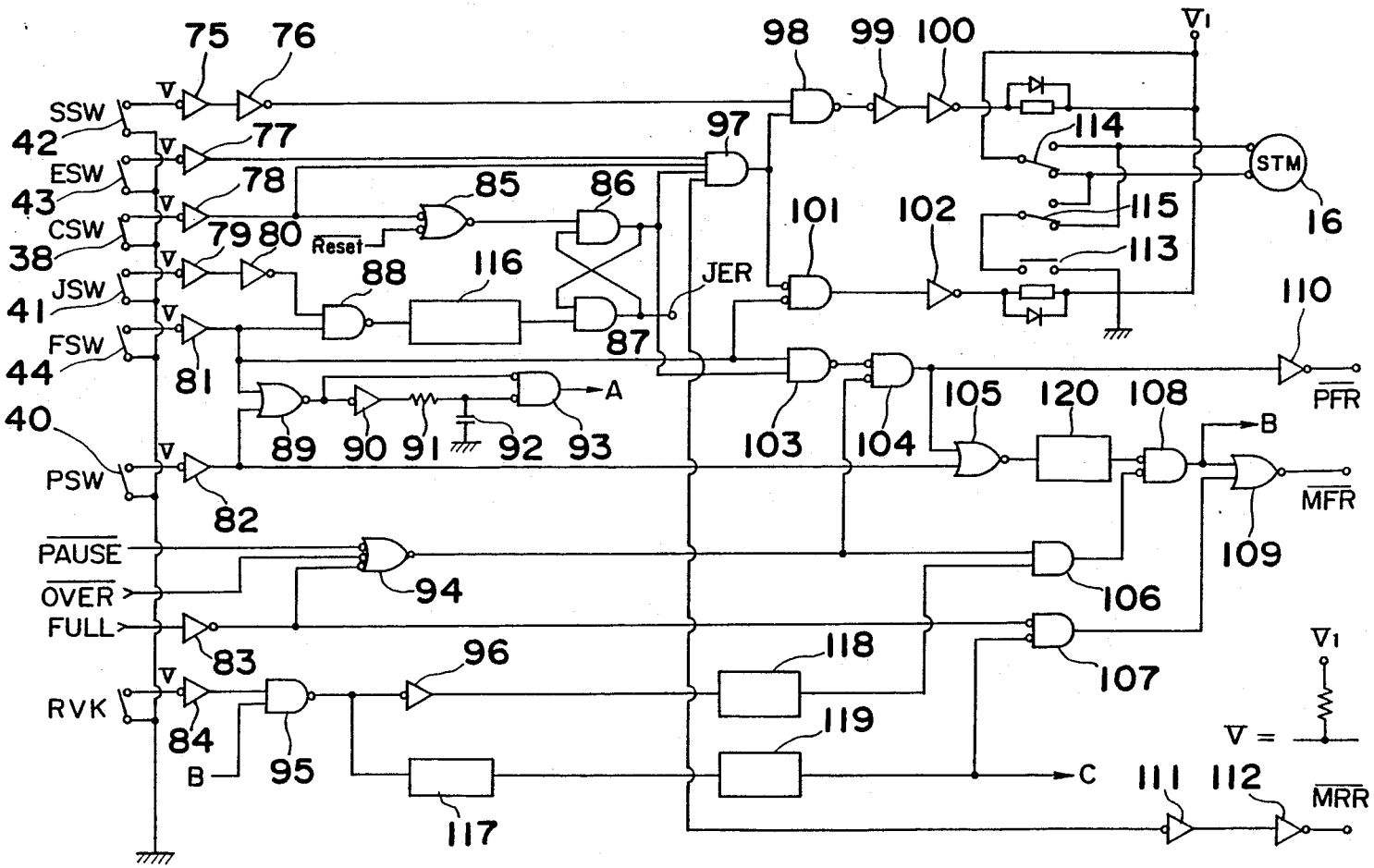
Figure 9:
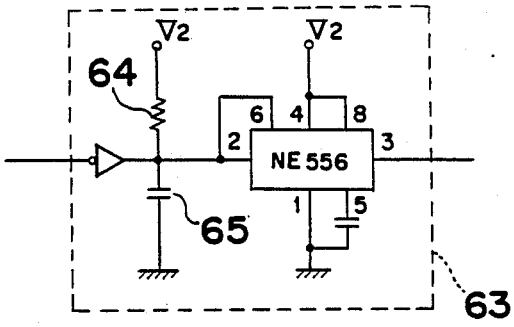
Figure 19:
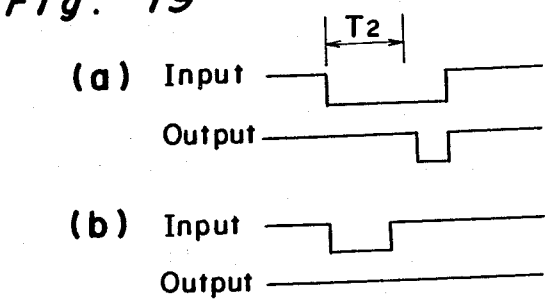
FIGS. 19*a* and 19*b* are diagrams showing waveforms of input and output signals in the circuits.

In FIG. 8, reference numeral 63 represents a timer circuit, the details of which are illustrated in FIG. 9. Also, the relationships between inputs to and outputs from the timer circuit 63 are shown in FIGS. 19(*a*) and 19(*b*). As best shown in FIG. 19(*a*), when an input signal applied to the timer circuit 63 is in low level state for a length of time greater than a predetermined time T1, the timer circuit 63 generates a low level output signal during a period subsequent to the passage of the predetermined time T1 and before the input signal applied to the timer circuit 63 is again rendered to be in high level state. Similarly, as shown in FIG. 19(*b*), in the event that the input signal applied to the timer circuit 63 is in low level state for the predetermined time T1, the output signal from the timer circuit 63 remains unchanged and in high level state. The predetermined time T1 referred to above can be chosen as desired by selecting the resistance of a resistor 64 and the capacitance of a capacitor 65.

Figure 10:
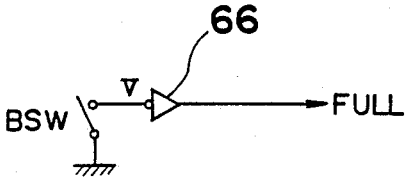

FIG. 10 illustrates an input circuit connected with a basket sensor switch (BSW) for detecting that the container is full of shredded pieces of papers. This basket sensor switch (BSW) is adapted to be switched on when the container is full of the shredded pieces of papers, in which condition an inverter 66 generates a high level signal FULL indicative of the full condition of the container.

Figure 11:
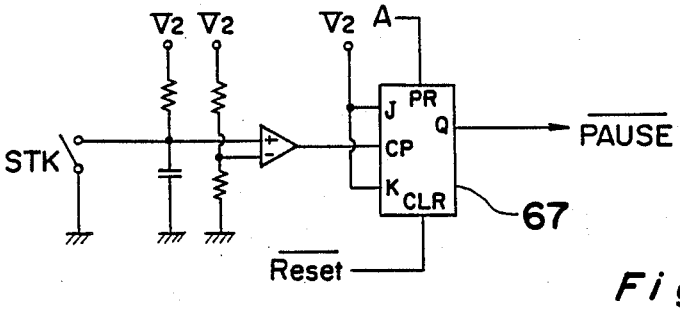

FIG. 11 illustrates an input circuit connected with a Start/Stop key (STIC). In this figure, reference numeral 67 represents a J-K flip-flop circuit having a clock pulse input terminal and is operable as to generate from a Q output terminal an inverted version of the previous output signal when a set-up signal is applied to a CP terminal. However, when a set-up signal is applied to a CP terminal. However, when a set-up signal is applied to a preset input terminal PR, the output from the Q terminal is a high level state regardless of whether it has been in low level state or whether it has been in high level state. In the event that a set-up signal is applied to a clear terminal CLR, the output from the Q terminal is in low level state regardless of whether it has been in high level state or whether it has been in low level state.

The output signal from the Q terminal of the flip-flop circuit 67 is designated by $\overline{\text{PAUSE}}$. Accordingly, unless the set-up signal is applied to the PR terminal and the CLR terminal, the signal $\overline{\text{PAUSE}}$ is inverted each time the Start/Stop key is depressed.

Figure 12:
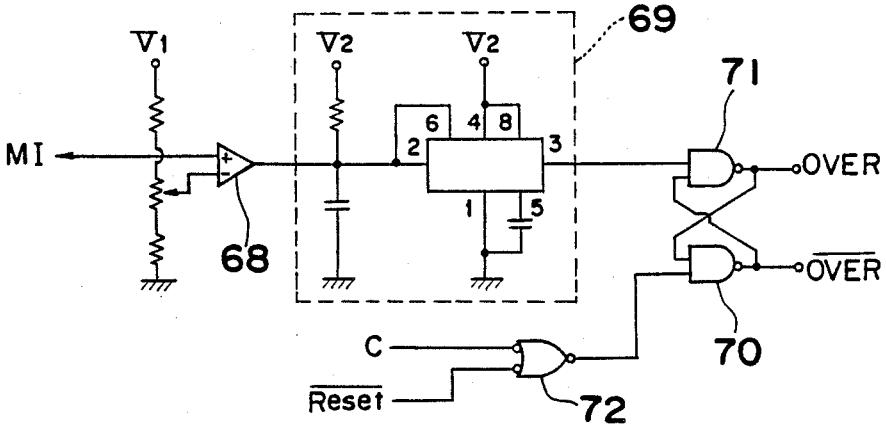

FIG. 12 illustrates a detector circuit for detecting the excessive load which would be imposed on the cutter drive motor 8 because of too many papers are drawn into the cutting zone between the cutting rollers 6*a* and 6*b*. Reference character MI represents a signal indicative of the voltage proportional to the amount of current flowing across the cutter drive motor 8. This detector circuit includes a comparator 68 and a timer circuit 69 connected in series therewith. The comparator 69 generates a high level signal when the amount of current flowing across the cutter drive motor 8 is greater than a predetermined value, which high level signal is in turn applied to the timer circuit 69 so that the timer circuit 69 can generate a low level signal. The timer circuit 69 is employed for the purpose of noise elimination and may not be always essential in the practice of the present invention. Where the timer circuit is employed such as shown, the timer circuit 69 is preferred to have a delay time within the range of some tens of milliseconds to some hundreds of milliseconds.

The detector circuit also includes NAND gates 70 and 71 which normally generate a low level output and a high level output, respectively. Specifically, in the event that the cutter drive motor 8 is overloaded with the consequence that the timer circuit 69 generates a low level signal, the NAND gate 70 generates a low level signal and the NAND gate 71 generates a high level signal. The respective output signals from the NAND gates 70 and 71 are designed by $\overline{\text{OVER}}$ and OVER.

Accordingly, in the event that the cutter drive motor 8 is overloaded, the OVER signal is in high level state while the inverted version thereof, that is, the $\overline{\text{OVER}}$ signal, is in low level state. If a NOR gate 72 generates a high level signal during this condition, the OVER signal is caused to be in a low level state.

The NOR gate 72 has two input terminals to which a signal C responsive to the reverse drive signal of the cutting rollers 6*a* and 6*b* and a reset signal $\overline{\text{Reset}}$ generated when the main power switch 50 is closed as well be subsequently described are respectively applied.

Figure 13:
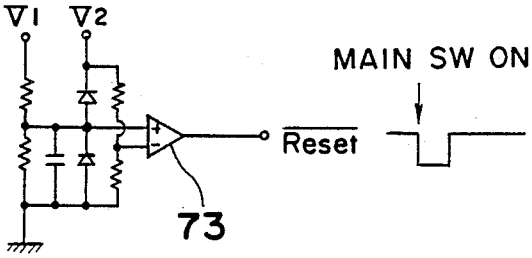

FIG. 13 illustrates a signal generating circuit for generating the reset signal when the main power switch 50 is closed. As can readily be understood, when the main power switch 50 is closed, a comparator 73 generates a signal which is in low level state only for a predetermined time subsequent to the closure of the main power switch 50, which signal is designated by $\overline{\text{RESET}}$.

Figure 14:
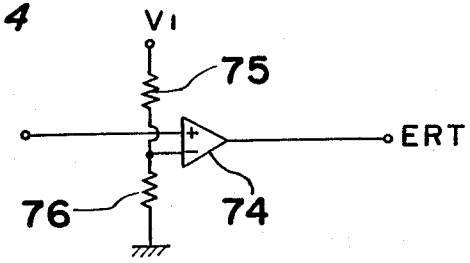

FIG. 14 shows a temperature detecting circuit for detecting an increase of the temperature of the cutter drive motor 8. Since the door sensor switch 55 is closed during the closure of the access door 12, a THP terminal generates a voltage of 24 volts. When the temperature of the cutter drive motor 8 increases, the thermo sensor switch 56 is closed and, therefore, an output voltage appearing at a terminal V1 becomes zero volt. Accordingly, when the thermo sensor switch 56 is opened, a comparator 74 generates a high level signal. Since the voltage divided by resistors 75 and 76 are so selected to be lower than 24 volts, the output from the comparator 74 is normally in low level state.

In FIG. 8, reference numerals 75 to 112 represent respective gate circuits, reference numeral 113 represents a normally opened contact, reference numerals 114 and 115 represent change-over switches, and reference numerals 116 to 120 represent respective timer circuits.

The operation of the control circuits described hereinabove will now be described with particular reference to the timing charts shown in FIGS. 15 to 18.

Figure 15:
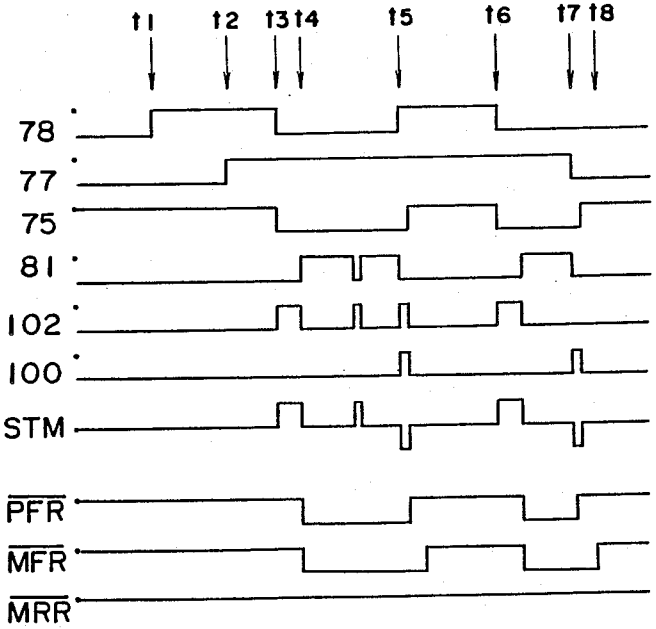

It is, however, to be noted that reference characters t1 to t8 used in FIG. 15 represent the following timings, respectively.

- t1: The protective cover 5 is opened with the switch 38 consequently turned off.
- t2: The stack of papers to be shredded is placed on the paper feed tray 4 with the switch 43 consequently turned on.
- t3: The protective cover 5 is closed with the switch 38 consequently turned on.
- t4 The shredding operation is initiated with the switch 44 turned on.
- t5: The protective cover 5 is opened during the shredding operation taking place, resulting in the switch 38 being turned off.
- t6: The protective cover 5 is closed after the stack of papers to be shredded has been supplemented, with the switch 38 turned on.
- t7: The paper feed tray 4 is emptied with all papers completely shredded, resulting the switch 43 being turned off.
- t8: The cutting rollers 6*a* and 6*b* are brought to a halt after the passage of a predetermined time subsequent to the timing t7, thereby completing the shredding operation.

When the protective cover 5 is opened at the timing t1, the output from the inverter 78 is brought into a low level state. When the stack of the papers is placed on the paper feed tray 4 at the timing t2, the switch 43 is turned on and the output from the inverter 77 is brought into a high level state.

When the protective cover 5 is closed at the timing t3, the inverter 78 generates a high level signal which is in turn applied to the AND gate 97 from which a high level signal is generated. Since the inverter 102 generates a low level signal before the switch 44 is closed, that is, the output from the inverter 81 is brought into a high level state, the normally opened contact 113 is closed to cause the direct current motor 16 to rotate in a positive direction so that the paper feed tray 4 can be pivoted about the pivot shaft 18 from the lowered position towards the elevated position.

At the subsequent timing t4, the uppermost sheet of the stack of papers on the paper feed tray 4 actuates the actuator 27 to turn the switch 44 on, with the consequence that the inverter 81 generates a high level signal. At the same time, both of $\overline{PFR}$ and $\overline{MFR}$ are brought into a low level state with the consequence that both of the synchronous motor 21 and the cutter drive motor 21 are driven, thereby initiating the shredding operation with the papers on the paper feed tray 4 drawn into the paper feed mouth 2 and towards the cutting zone between the cutting rollers 6*a* and 6*b*.

When the protective cover 5 is opened at the timing t5 while the shredding operation is taking place, the output signal from the AND gate 97 is caused to be in a low level state and the respective outputs from the inverter 100 and 102 are caused in to be in a low level state up until the switch 42 is turned on. Therefore, the change-over switches 114 and 115 are switched over in position to drive the direct current motor 16 in a negative direction opposite to the positive direction, causing the paper feed tray 4 to pivot from the elevated position towards the lowered position.

When the protective cover 5 is closed at the timing t6 after a number of papers to be shredded are added to the stack of paper already on the paper feed tray 4 and when the switch 38 is consequently turned on, the inverter 1023 continues generating a low level signal until the switch 44 is turned on, with the consequence that the paper feed tray 4 is moved from the lowered position towards the elevated position, followed by the continued shredding operation. Should all of the papers on the paper feed tray 4 have been completely drawn into the paper feed mouth 2 and towards the cutting zone, the switch 43 is turned off and the output from the inverter 77 is rendered to be in low level state. After the subsequent passage of a predetermined time, for example, about 3 seconds, set in the timer 120, MER is rendered to be in high level state causing the cutting rollers 6*a* and 6*b* to rotate.

Figure 16:
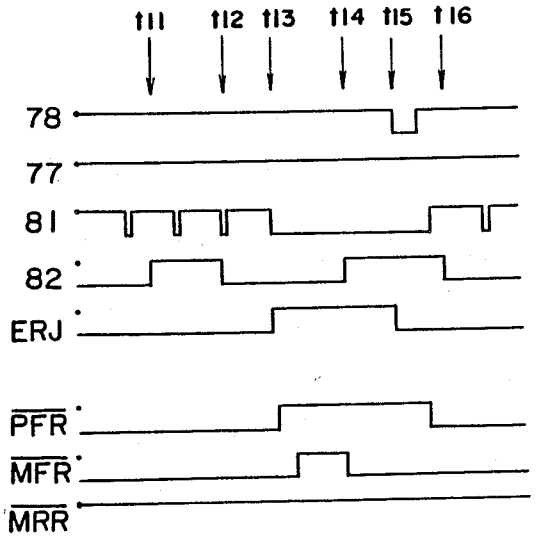

Reference characters t11 to t16 used in FIG. 16 represent the following timings, respectively, which occur during the shredding operation taking place with the utilization of the single feed system.

- t11: The shredding operation is initiated with papers inserted through the paper feed mouth 3.
- t12: The shredding operation with the utilization of the single feed system has ended.
- t13: Any trouble in the paper feed has occurred in the batch feed system.
- t14: The shredding operation with the utilization of the single feed system is initiated again.
- t15: The protective cover 5 is opened.
- t16: The shredding operation resumed is completed.

When some papers are inserted into the paper feed aperture 3 at the timing t11 during the execution of the shredding operation with the utilization of the batch feed system, the switch 40 is turned on and the output from the inverter 82 is rendered to be in high level state. The papers supplied by way of the batch feed system and the papers supplied by way of the single feed system join together in the cutting zone and are then shredded by the cutting rollers 6*a* and 6*b*. The shredding of the papers supplied by way of the single feed system terminates at the timing t12.

In the event of occurrence of a paper feed trouble at the timing t13 in the batch feed system, both of ERJ and $\overline{PFR}$ are caused to be in a high level state, with the consequence that the synchronous motor 21 is brought to a halt and the shredding operation of the papers supplied by way of the batch feed system is, therefore, interrupted.

When the papers are inserted into the paper feed mouth 2 at the timing t14 during the occurrence of the paper feed trouble in the batch feed system, the output from the NOR gate 105 is caused to be in a low level state regardless of the output of the AND gate 104 and, therefore, $\overline{MFR}$ is caused to be in a low level state, with the consequence that the cutter drive motor 8 is driven so that the papers inserted through the paper feed mouth 2 can be shredded at any time.

The opening of the protective cover 5 at the timing t15 renders ERJ to be in low level state, thereby removing the paper feed trouble once occurring. When the protective cover 5 is closed after the removal of the paper feed trouble, the shredding operation subject to the papers fed by way of the batch feed system (from the paper feed tray 4) can be resumed.

Figure 17:
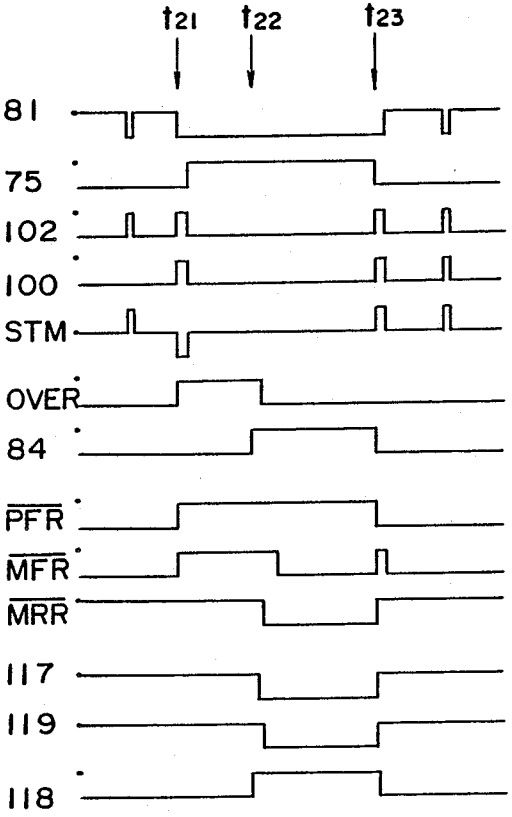

In FIG. 17, reference characters t21, t22 and t23 represent the timing at which the motor 8 is overloaded, the timing at which the reverse feed key is switched on, and the timing at which the reverse feed key is switched off, respectively.

In the event of the overloading of the motor 8 at the timing t21 during the execution of the shredding operation with the papers supplied by way of the batch feed system, the overload signal OVER is caused to be in a high level state and both of the outputs from the inverters 100 and 102 are caused to be in a high level state. Therefore, the paper feed tray 4 is lowered towards the lowered position while pivoting about the pivot shaft 18. The removal of the trouble resulting from the overloading of the motor 8 can be effected by depressing the reverse feed key to effect the reverse drive of the cutting rollers 6*a* and 6*b*.

Figure 18:
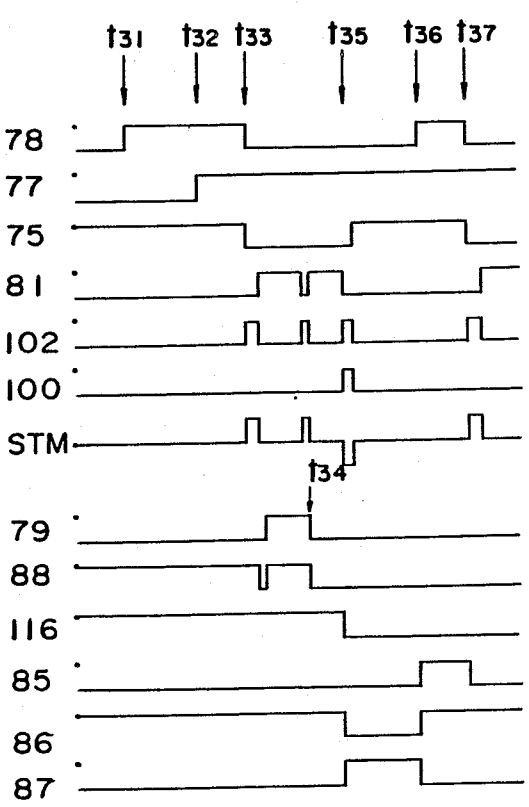
FIGS. 15 to 18 are timing charts showing the timed relationship of several operating components used in the control circuits in the shredder.

Timings t31 to t37 shown in the chart of FIG. 18 associated with the detection of the occurrence of a trouble in the feed of papers to be shredded are descriptive of the following occurrences, respectively.

- t31: The opening of the protective cover 5.
- t32: The setting of the papers to be shredded.
- t33: The closure of the protective cover 5.
- t34: Detection of the leading end of the paper drawn towards the cutting zone.
- t35: The passage of the predetermined time (about 3 seconds), set in the timer 116, subsequent to the timing t34, with no leading end of the next succeeding paper detected. This is indicative of the occurrence of the paper feed trouble.
- t36: The opening of the protective cover 5 to remove the paper feed trouble.
- t37: The closure of the protective cover 5 to resume the shredding operation.

It is to be noted that the timings t31 to t33 shown in the chart of FIG. 18 are identical with the timings t1 to t3 shown in the chart of FIG. 15.

When the output from the inverter 79 is caused to be in a low level state at the timing t34, it means that the passage of the trailing end of one of the papers past the position of the switch 41 has been detected by the switch 41. However, since the output from the inverter 79 can be a in high level state at the timing t35 the predetermined time subsequent to the timing t34, the output from the timer 116 is caused to be in a low level state with the consequence that of outputs from the AND gates 86 and 87 are caused to be in a low and high level states, respectively. Simultaneously therewith, both of outputs from the inverters 100 and 102 are caused to be in a low level state and, therefore, the paper feed tray 4 can be moved towards the lowered position about the pivot shaft 18.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claim is:

1. A shredding machine which comprises:

a cutting means for shredding paper material;

a paper feed mechanism including a paper feed tray adapted to support thereon the paper material to be shredded and a paper feed means for feeding the paper material from the paper feed tray towards the cutting means;

a first detector for detecting the presence of the paper material on the paper feed tray;

a second detector disposed in a path of travel of the paper material from the paper feed mechanism to the cutter means;

means for determining, during a period in which the first detector detects the presence of the paper material on the paper feed tray, whether or not the time passed from the timing, at which the second detector detects the passage of the trailing end of one paper material therethrough with respect to the direction of feed towards the cutting means, to the timing at which the second detector detects the passage of the leading end of the next succeeding paper material therethrough with respect to the direction towards the cutting means has exceeded a predetermined time; and a control means operable in response to a signal from the determining means to interrupt the operation of the paper feed mechanism.

2. A shredding machine, comprising:

cutting means for shredding paper material;

a paper feed tray movable between lowered and elevated positions and adapted to support thereon the paper material to be shredded;

feed means for feeding the paper material from the paper feed tray towards the cutting means;

detecting means for detecting the occurrence of a fault in the paper feed means and generating an output signal; and lowering means operable in response to said output signal from the detecting means to move the paper feed tray from the elevated position towards the lowered position for enabling correction of said fault.

3. The machine as claimed in claim 2 and further comprising a protective cover supported for movement between closed and opened positions and for covering a space above the paper feed tray when in the closed position, and wherein the fault is correctable when the protective cover is moved to the opened position and then back to the closed position, thereby enabling the machine to resume a shredding operation.

4. A shredding machine, comprising:

cutting means for shredding paper material to be shredded;

a paper feed mechanism including a paper feed tray adapted to support the paper material to be shredded thereon and a feed roller assembly for drawing the paper material from the paper feed tray towards the cutting means; and means for moving the paper feed tray in a direction away from the feed roller assembly when the direction of rotation of the cutting means is reversed, thereby forming a space between and feed roller assembly and the paper material, placed on the paper feed tray, when the cutter means is driven in the reverse direction.

* * * * *